United States Patent [19]

Cummins

[11] Patent Number: 4,497,423

[45] Date of Patent: Feb. 5, 1985

[54] CLOTHES HANGER HAVING SHROUD TO MAINTAIN GARMENTS IN ROLLED CONDITION

[76] Inventor: Pamela R. Cummins, 602/2 Broughton Rd., Artarmon, NSW 2064, Australia

[21] Appl. No.: 374,163

[22] Filed: May 3, 1982

[30] Foreign Application Priority Data

Nov. 13, 1981 [AU] Australia ..... PF1550

[51] Int. Cl.[3] ..... A47J 51/086; A47J 51/14

[52] U.S. Cl. ..... 223/96

[58] Field of Search ..... 223/85, 96, 95; 24/256, 24/265 H, DIG. 29, 256; 2/47, 59, 170

[56] References Cited

U.S. PATENT DOCUMENTS

| | | | |
|---|---|---|---|
| 89,879 | 5/1869 | Meyenberg | 24/256 X |
| 143,063 | 9/1873 | Clifford | 24/256 X |
| 796,695 | 8/1905 | Blake | 24/256 X |
| 815,998 | 3/1906 | Wolff | 2/170 |
| 853,121 | 5/1907 | Saundry | 24/265 H X |
| 2,743,855 | 5/1956 | Hochfelder | 223/85 |
| 2,766,917 | 10/1956 | Jang | 223/95 |
| 3,448,903 | 6/1969 | Snow | 223/96 |

FOREIGN PATENT DOCUMENTS

| | | | |
|---|---|---|---|
| 632444 | 12/1961 | Canada | 223/95 |

*Primary Examiner*—Robert R. Mackey

*Attorney, Agent, or Firm*—McAulay, Fields, Fisher, Goldstein & Nissen

[57] ABSTRACT

A clothes hanger includes a resiliently deformable clamping member movable from a normally compressed state to an expanded state in response to an expanding force to receive a rolled up article of clothing therein and for retaining the article of clothing in the rolled up condition in response to the removal of the expanding force. The clamping member is then hung with a retained article of clothing on a closet bar. A method of hanging clothes includes rolling a garment and then clamping with the deformable clamping member.

1 Claim, 4 Drawing Figures

CLOTHES HANGER HAVING SHROUD TO MAINTAIN GARMENTS IN ROLLED CONDITION

BACKGROUND OF THE INVENTION

The present invention relates to a clothes hanger, particularly suitable for skirts or garments of that nature, and a method of hanging clothes such as skirts and the like.

Conventional clothes hangers, such as the standard wire, plastic or wooden coat hangers, are, as their names suggest, constructed so as to be suitable for garments such as coats or shirts, that is, garments which clothe the torso. Skirts or trousers must be hung over the rung of such hangers and this leads to an unsightly crease at the point of contact with the rung. In order to avoid this problem, specially constructed skirt hangers have been made available by which skirts and/or trousers are suspended by their waistbands or cuffs by means of clips attached to the main body of the hanger. While this has avoided the aforementioned cause of a crease on the garment, even with this specially constructed skirt hanger, the garments will be creased if the garment is suspended thereby and placed in a closet crushed between other clothes.

SUMMARY OF THE INVENTION

The main object of the present invention is to provide a clothes hanger and a method of hanging clothes which is particularly suitable for garments such as skirts and which substantially avoids the problem of creasing of the garment during the hanging or storage thereof.

The clothes hanger and method in accordance with the present invention are based upon the discovery that if a skirt or similar garment is rolled about its length and suspended from its waistband or thereabouts, the problem of creasing during the hanging thereof is substantially overcome. The present invention provides a clothes hanger by which the garment may be conveniently hung in a rolled-up condition.

This and other objects of the present invention are achieved in accordance with the present invention by a clothes hanger which has releasably deformable clamping means movable from a normally compressed state to an expanded state in response to an expanding force to receive a rolled-up article of clothing therein and for retaining the article of clothing in the rolled-up condition in response to the removal of the expanding force. The clamping means has means connected thereto for hanging the clamping means with a retained article of clothing on a closet bar or the like.

In a preferred embodiment, the clothes hanger further comprises a tubular shroud composed of expandable material which can be rolled up over the clamping means before the clamping of a rolled-up article of clothing and thereafter rolled down over the article of clothing to enclose same when suspended from the clamping means by way of the hanging means.

The clamping means preferably comprises a circular loop or band of spring material which has an internal clamping surface and overlapping end portions in at least the compressed state thereof. The band is expanded in diameter to receive the rolled-up article of clothing and retained within the band by the tendency of the band to return to its compressed state.

The clamping means may also comprise a U-shaped clamping member of spring material or a helical closed loop.

The hanging means preferably comprises a strap connected at one end to the clamping means and having a hook at the other end thereof and an eyelet connected to the clamping means opposite the strap connection and engageable with the hook. The hanging means may also comprise a rigid hook connected through an eyelet on the clamping means and which may be permanently or removably connected to the clamping means.

The invention will be better understood from the following description taken in conjunction with the accompanying drawings wherein:

DETAILED DESCRIPTION OF THE PREFERRED EMBODIMENTS

Figure 1:
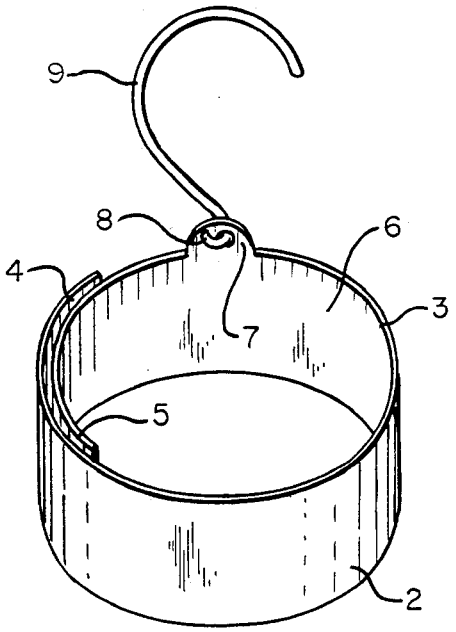
FIG. 1 is a perspective schematic view of one embodiment of the clothes hanger according to the present invention.

Referring now to FIG. 1, the clothes hanger according to the present invention comprises clamping means 2 formed from resilient sheet material which defines a closed loop or band 3 which holds a rolled garment such as a skirt rolled about an axis along its length (not shown) by a clamping effect between the garment and the internal surface 6 of the clamping band 3. The clamping band 3 is shown in its normal compressed state with ends 4 and 5 overlapping. When a force is applied internally of the band 3, the band is deformed from its rest position so as to increase its diameter and reduce the overlap between end portions 4 and 5. The band can then be placed around the waistband of the rolled up skirt and when the expansion force applied to the band is removed, the band will tend to return to its rest position thus clamping the garment and thereby retaining it in its rolled up condition.

The clamping means 2 may be suspended from a closet bar or other available projection by hanging means which comprises hook 9 shown in FIG. 1 which has an end portion 8 which is disposed through an eyelet 7 in the band 3. As shown, the hook 9 can be removed from the eyelet, if desired.

Figure 2:
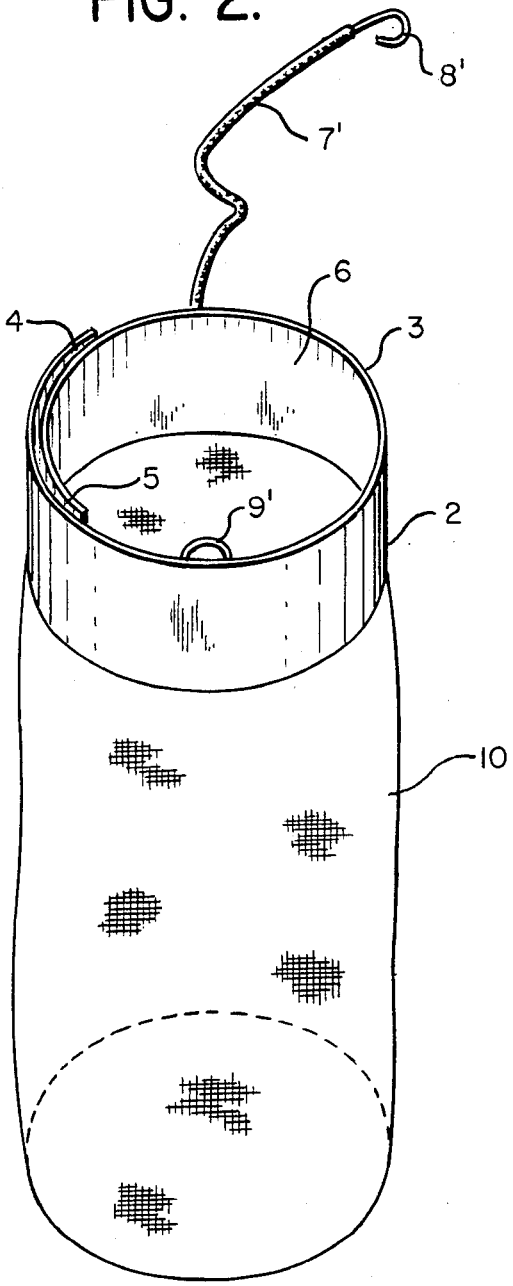
FIG. 2 is a perspective schematic view of an alternative embodiment of the clothes hanger including a tubular shroud.

In an alternative embodiment shown in FIG. 2, the clamping means 2 is substantially the same in that it includes the band 3 with overlapping portions 4 and 5, however the hanging means comprises a strap or tape 7' connected at one end to the band 3 and having a hook 8' at the other end thereof. The hook 8' is engageable with an eyelet 9' connected on the band 3 opposite the strap connection to the band 3.

The embodiment of FIG. 2 also includes a tubular shroud 10 which is configured to cover a garment when the garment is suspended from the clamping means 2. Preferably, the shroud 10 is composed of an elastic or stretch material which is capable of being rolled over the band 3 when not in use. In use, the shroud 10 is rolled over the garment, after it is clamped by clamping means 2, to retain the entire garment in its rolled-up condition. Preferably, the shroud is of a similar weave and material to a stocking material, for example 12 to 18 denier nylon. It has been found that once the shroud is placed over the rolled-up garment, subsequent creasing of the garment when stored in a closet or the like is not encountered. The shroud has a further advantage of providing a cover for the garment and thus reducing the possibility of soiling or damage from other clothing, moths, etc.

The method of hanging clothes according to the present invention thereby includes rolling the article of clothing around a lengthwise axis thereof into a substantially cylindrical configuration, clamping the rolled-up article at the top thereof to retain same in the rolled-up condition and hanging the article of clothing in the clamped rolled-up condition.

A further advantage of the hanger and the method of hanging according to the present invention is the ability to pack up garments for traveling whereby the rolled up and clamped garment may merely be removed from the closet and placed, in its rolled-up condition, in a suitcase or trunk.

Figure 3:
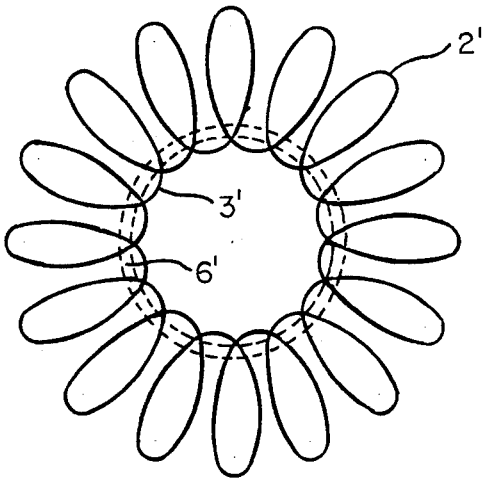
FIG. 3 is a plan view of an alternative embodiment of the clamping means.

In another embodiment shown in FIG. 3, the clamping means 2' comprises a helical closed loop 3', wherein the axis of the helix defines a substantially closed area. The helical closed loop 3' may comprise elastically deformable material or, the elasticity thereof may be provided by an elastic or corrogated ring 6' passing therethrough.

Figure 4:
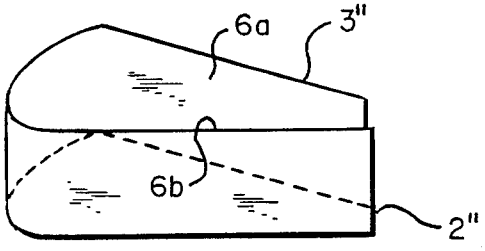
FIG. 4 is a perspective schematic view of another embodiment of the clamping means.

In a further embodiment shown in FIG. 4, the clamping means 2'' comprises a U-shaped clamping member 3'' which pinches the rolled-up garment between the internal walls of the arms *6a* and *6b* thereof to retain the rolled-up garment therebetween.

Preferably, the clamping members 3 and 3'' comprise a plastic material which is formed to the desired circumference which will deform to a circumference sufficient to allow a garment to be inserted through the loop or to be removed therefrom.

Although the particular utility of the hanger and the method of hanging according to the present invention has been described with reference to clothes and in particular skirts, it will be appreciated that the hanger has various applications in other areas, although the particular depicted embodiments are particularly devised to substantially eliminate the problem of creasing of skirts while hanging in a closet or the like.

While the invention has been particularly shown and described with reference to preferred embodiments thereof, it will be understood by those skilled in the art that various changes in form and details may be made therein without departing from the spirit and scope of the invention.

What I claim is:

1. A clothes hanger for hanging and for reducing creasing of a garment during packing and movement of the same comprising a resiliently expandable, circular clamping band of spring material, said clamping band having an internal clamping surface and end portions, said clamping band being movable from a normally compressed state in which said end portions overlap to an expanded state in response to an expanding force to receive a rolled-up article of clothing therein and for retaining the article of clothing in the rolled up condition in response to the removal of the expanding force, said rolled up article of clothing receivable within said band in response to an increase in the diameter thereof and retainable in said band by a clamping force exerted by said clamping surface due to the tendency of said band to return to the compressed state; and hanging means fixedly connected at only one end thereof to the clamping band for hanging the clamping band with a retained article of clothing on a closet bar, said hanging means comprises a strap connected at one end to the clamping band, a hook connected to the other end of the strap and an eyelet connected on the clamping band opposite from the strap connection and engagable with said hook; and a tubular shroud of stretchable material connected at one end to said clamping band and extending downwardly therefrom whereby said shroud provides an enclosed member to encase and contain the article of clothing received in said clamping band to prevent creasing of the garment.

* * * * *